US006863341B1

(12) United States Patent
Wen

(10) Patent No.: US 6,863,341 B1
(45) Date of Patent: Mar. 8, 2005

(54) FOLDABLE CHAIR

(76) Inventor: Yong-Chang Wen, 3, San Yi Village, Da Bei Shian, Yun Lin Hsien (TW)

( * ) Notice: Subject to any disclaimer, the term of this patent is extended or adjusted under 35 U.S.C. 154(b) by 0 days.

(21) Appl. No.: 10/755,886

(22) Filed: Jan. 12, 2004

(51) Int. Cl.[7] ..... A47C 3/04; A47C 4/04

(52) U.S. Cl. ..... 297/23; 297/24; 297/26; 297/58; 297/239; 297/248

(58) Field of Search ..... 297/22, 23, 24, 297/25, 26, 55, 58, 239, 248

(56) References Cited

U.S. PATENT DOCUMENTS

| | | | | | |
|---|---|---|---|---|---|
| 82,494 | A | * | 9/1868 | Collignon et al. | 297/58 |
| 98,743 | A | * | 1/1870 | Comins | 297/26 |
| 192,284 | A | * | 6/1877 | Richardson | 297/26 |
| 321,825 | A | * | 7/1885 | Koenig, Jr. | 297/248 X |
| 1,129,793 | A | * | 2/1915 | Graig | 297/58 |
| 1,372,546 | A | * | 3/1921 | Read et al. | 297/23 |
| 1,934,396 | A | * | 11/1933 | Bales | 297/58 |
| 2,207,338 | A | * | 7/1940 | Clarin | 297/58 |
| 2,267,963 | A | * | 12/1941 | Donald et al. | 297/23 |
| 2,637,081 | A | * | 5/1953 | Henrikson et al. | 297/248 X |
| 2,654,419 | A | * | 10/1953 | Nordmark | 297/58 |
| 2,727,563 | A | * | 12/1955 | Cook | 297/24 |
| 2,750,990 | A | * | 6/1956 | Eves | 297/248 |
| 2,757,717 | A | * | 8/1956 | Adler | 297/58 |
| 2,821,762 | A | * | 2/1958 | Foose | 297/248 X |
| 2,843,186 | A | * | 7/1958 | Spencer | 297/248 |
| 2,843,187 | A | * | 7/1958 | Manne et al. | 297/58 |
| 3,021,175 | A | * | 2/1962 | Norquist | 297/58 |
| 3,100,125 | A | * | 8/1963 | Henri | 297/26 |
| 3,188,138 | A | * | 6/1965 | Lockshin | 297/248 |
| 3,383,738 | A | * | 5/1968 | Fox et al. | 297/248 X |
| 4,218,089 | A | * | 8/1980 | Beltrami et al. | 297/58 |
| 4,341,417 | A | * | 7/1982 | Deconinck | 297/24 |
| 5,096,259 | A | * | 3/1992 | Stanfield | 297/239 |
| 5,154,472 | A | * | 10/1992 | Kaufman | 297/23 |
| 5,738,408 | A | * | 4/1998 | Wu | 297/239 |
| 5,967,605 | A | * | 10/1999 | Stanfield | 297/239 |
| 6,099,073 | A | * | 8/2000 | Bruschi | 297/58 X |
| 6,131,992 | A | * | 10/2000 | Chang | 297/58 |
| 6,234,571 | B1 | * | 5/2001 | Atkins et al. | 297/239 X |
| 6,422,645 | B1 | * | 7/2002 | Smith et al. | 297/239 X |
| 6,478,375 | B2 | * | 11/2002 | Richardson | 297/248 |
| 6,592,182 | B1 | * | 7/2003 | Noor | 297/239 |
| 6,669,281 | B1 | * | 12/2003 | Huang | 297/58 |
| 6,742,839 | B2 | * | 6/2004 | Piretti | 297/239 |
| 2003/0071494 | A1 | * | 4/2003 | Leng | 297/58 |
| 2004/0004371 | A1 | * | 1/2004 | Noor | 297/58 |

* cited by examiner

*Primary Examiner*—Rodney B. White
(74) *Attorney, Agent, or Firm*—Alan D. Kamrath; Nikolai & Mersereau, P.A.

(57) ABSTRACT

A foldable chair includes a first leg, a second leg pivotally connected with the first leg, and a seat module pivotally mounted on the first leg and detachably locked on the second leg. The second leg is formed with a forward protruding holding portion formed with a downward facing locking recess. The seat module includes a support frame pivotally connected with the first leg and formed with an upward protruding catch portion rested on the holding portion and detachably locked in the locking recess, so that the seat module is combined with the second leg. Thus, the expanded foldable chair has a rigid and stable structure.

7 Claims, 8 Drawing Sheets

FOLDABLE CHAIR

BACKGROUND OF THE INVENTION

1. Field of the Invention

The present invention relates to a foldable chair, and more particularly to a foldable chair that saves the space of storage and has a rigid and stable structure.

2. Description of the Related Art

A conventional fixed chair forms a rigid and stable support to the user, so that the user can be seated on the chair comfortably. However, the conventional fixed chair has a fixed volume and cannot be folded, thereby causing inconvenience to the user when carrying and storing the chair.

SUMMARY OF THE INVENTION

The primary objective of the present invention is to provide a foldable chair that can save the space of storage.

Another objective of the present invention is to provide a foldable chair, wherein the expanded foldable chairs are combined with and detached from each other easily and rapidly, thereby facilitating the user combining and detaching the expanded foldable chairs.

A further objective of the present invention is to provide a foldable chair, wherein the collapsed foldable chairs are combined with and detached from each other easily and rapidly, thereby facilitating the user combining and detaching the collapsed foldable chairs.

A further objective of the present invention is to provide a foldable chair, wherein the collapsed foldable chairs are laminated rigidly and stably when not in use, thereby preventing the collapsed foldable chairs from falling down unintentionally so as to protect the people's safety.

In accordance with the present invention, there is provided a foldable chair, comprising a first leg, a second leg pivotally connected with the first leg, and a seat module pivotally mounted on the first leg and detachably locked on the second leg, wherein:

- the second leg is formed with a forward protruding holding portion formed with a downward facing locking recess;
- the seat module includes a support frame pivotally connected with the first leg; and
- the support frame of the seat module has an end formed with an upward protruding catch portion rested on the holding portion of the second leg and detachably locked in the locking recess of the holding portion, so that the support frame of the seat module is combined with the second leg.

Further benefits and advantages of the present invention will become apparent after a careful reading of the detailed description with appropriate reference to the accompanying drawings.

DETAILED DESCRIPTION OF THE INVENTION

Figure 1:
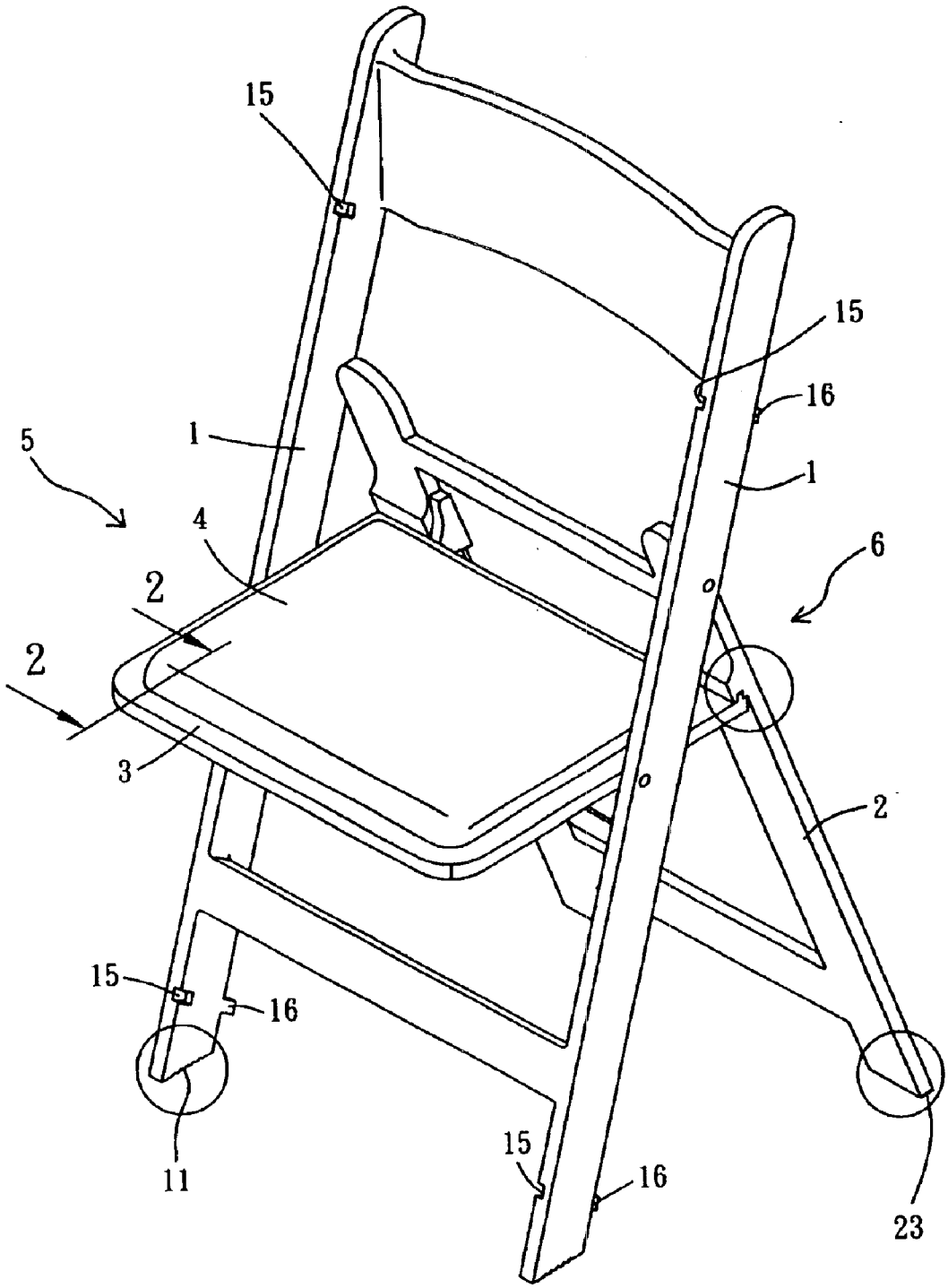
FIG. 1 is a perspective view of a foldable chair in accordance with the preferred embodiment of the present invention.

Referring to the drawings and initially to FIGS. 1–6, a foldable chair 6 in accordance with the preferred embodiment of the present invention comprises a first leg 1, a second leg 2 pivotally connected with the first leg 1, and a seat module 5 pivotally mounted on the first leg 1 and detachably locked on the second leg 2.

The seat module 5 includes a support frame 3 pivotally connected with the first leg 1, and a seat cushion 4 secured on the support frame 3.

Figure 2:
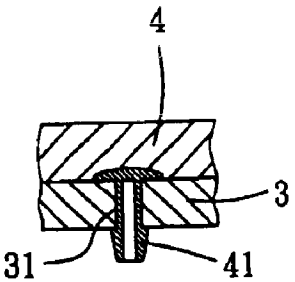
FIG. 2 is a plan cross-sectional view of the foldable chair taken along line 2—2 as shown in FIG. 1.

As shown in FIGS. 1 and 2, the support frame 3 of the seat module 5 has a periphery formed with a plurality of locking holes 31, and the seat cushion 4 has a periphery formed with a plurality of elastic locking tenons 41 each snap locked in a respective one of the locking holes 31 of the support frame 3, so that the seat cushion 4 is secured on the support frame 3.

Figure 3:
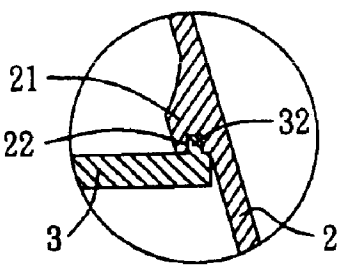
FIG. 3 is a partially enlarged plan cross-sectional view of the foldable chair as shown in FIG. 1.

As shown in FIGS. 1 and 3, the second leg 2 is formed with a forward protruding holding portion 21 formed with a downward facing locking recess 22, and the support frame 3 of the seat module 5 has an end formed with an upward protruding catch portion 32 rested on the holding portion 21 of the second leg 2 and detachably locked in the locking recess 22 of the holding portion 21, so that the support frame 3 of the seat module 5 is combined with the second leg 2 rigidly and stably.

Figure 4:
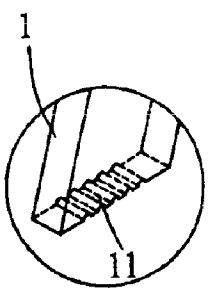
FIG. 4 is a partially enlarged perspective view of the foldable chair as shown in FIG. 1.

As shown in FIGS. 1 and 4, the first leg 1 has a lower end formed with an anti-skid face 11.

Figure 5:
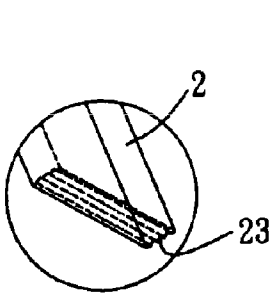
FIG. 5 is a partially enlarged perspective view of the foldable chair as shown in FIG. 1.

As shown in FIGS. 1 and 5, the second leg 2 has a lower end formed with anti-skid face 23.

Figure 6:
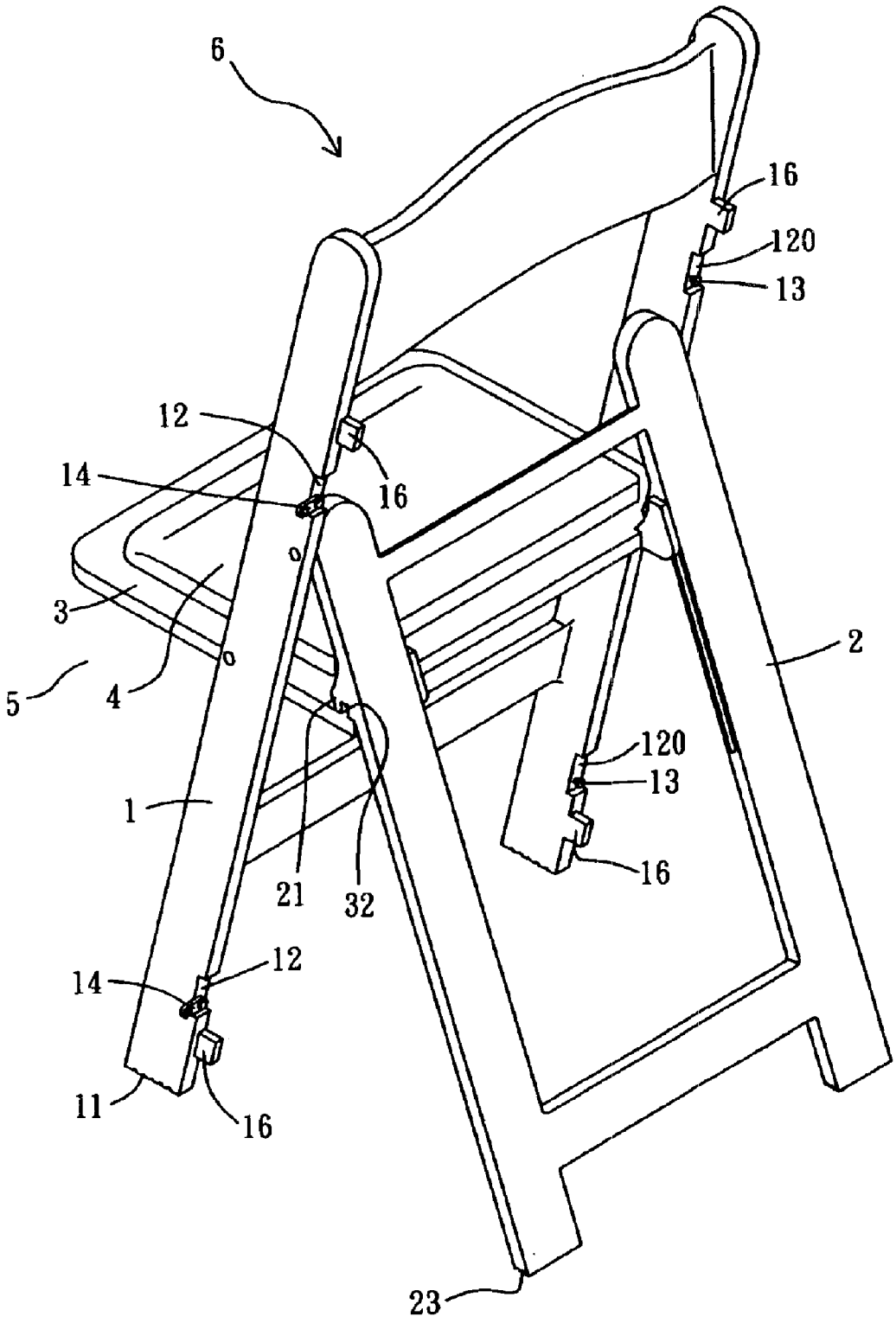
FIG. 6 is a perspective view of the foldable chair in accordance with the preferred embodiment of the present invention.

As shown in FIGS. 1 and 6, the first leg 1 has a first side formed with two spaced first openings 12 each provided with a movable snap 14 and a second side formed with two spaced second openings 120 each provided with a protruding post 13. In addition, each of the first side and the second side of the first leg 1 has two ends each having a first section formed with a concave portion 15 and a second section formed with a convex portion 16 aligning with the concave portion 15.

Figure 7:
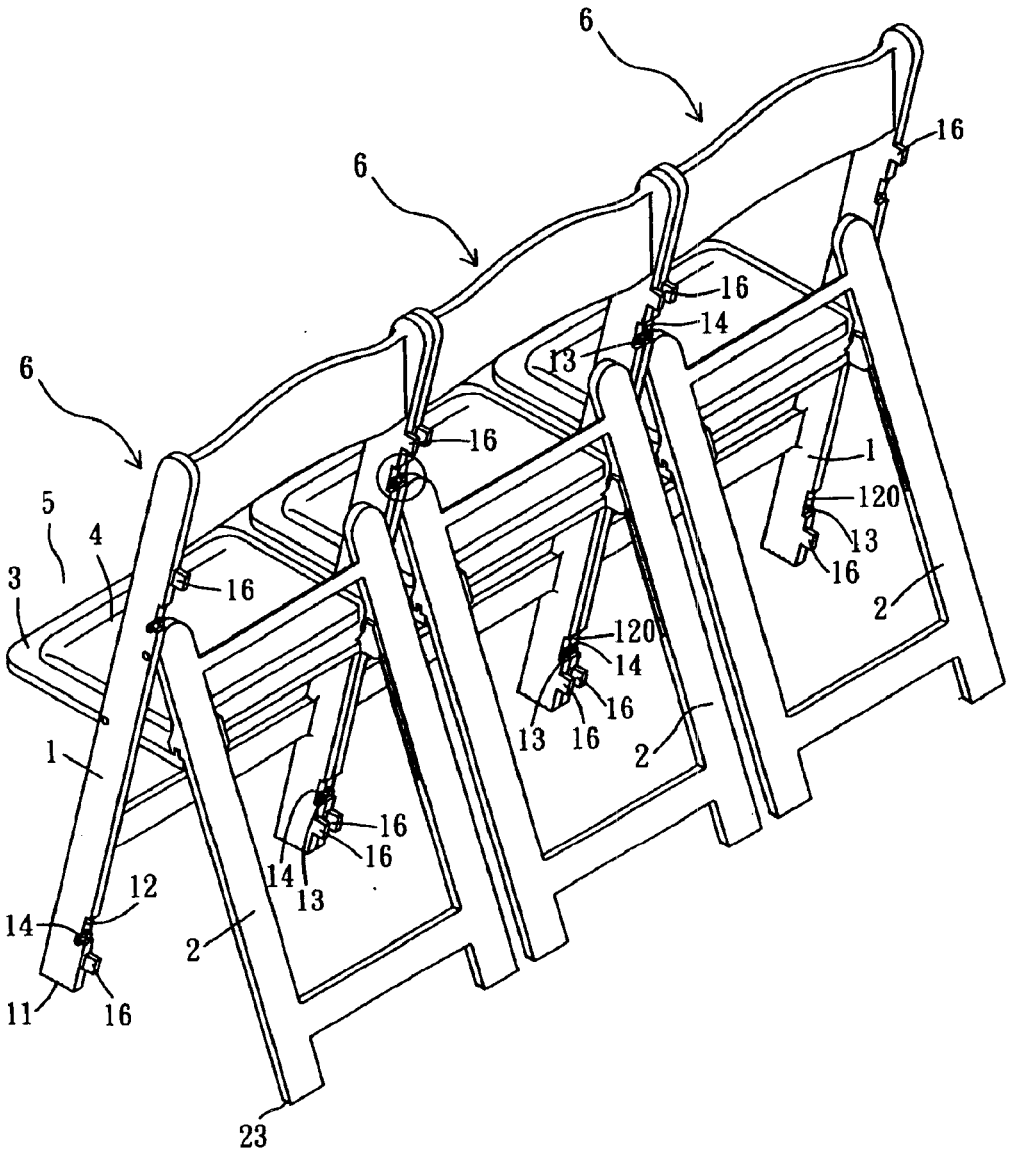
FIG. 7 is a perspective view showing a plurality of expanded foldable chairs are combined.
Figure 8:
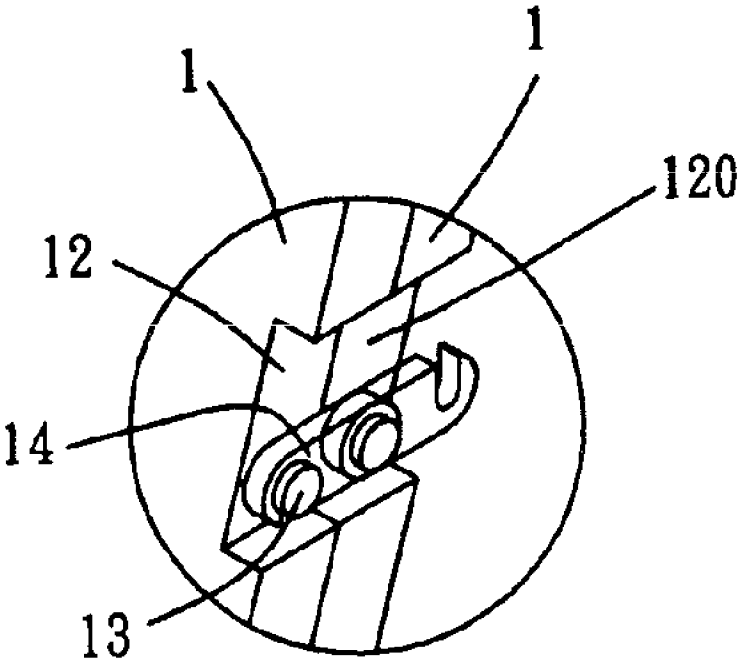
FIG. 8 is a partially enlarged perspective view of the foldable chairs as shown in FIG. 7.

Referring to FIGS. 7 and 8 with reference to FIGS. 1–6, when a plurality of expanded foldable chairs 6 are juxtaposed with each other, the movable snap 14 of one foldable chair 6 is pivoted outward and is locked on the respective protruding post 13 of another adjacent foldable chair 6, so as to combine the foldable chairs 6. Thus, the foldable chairs 6 are combined with and detached from each other easily and rapidly, thereby facilitating the user combining and detaching the expanded foldable chairs 6.

Figure 9:
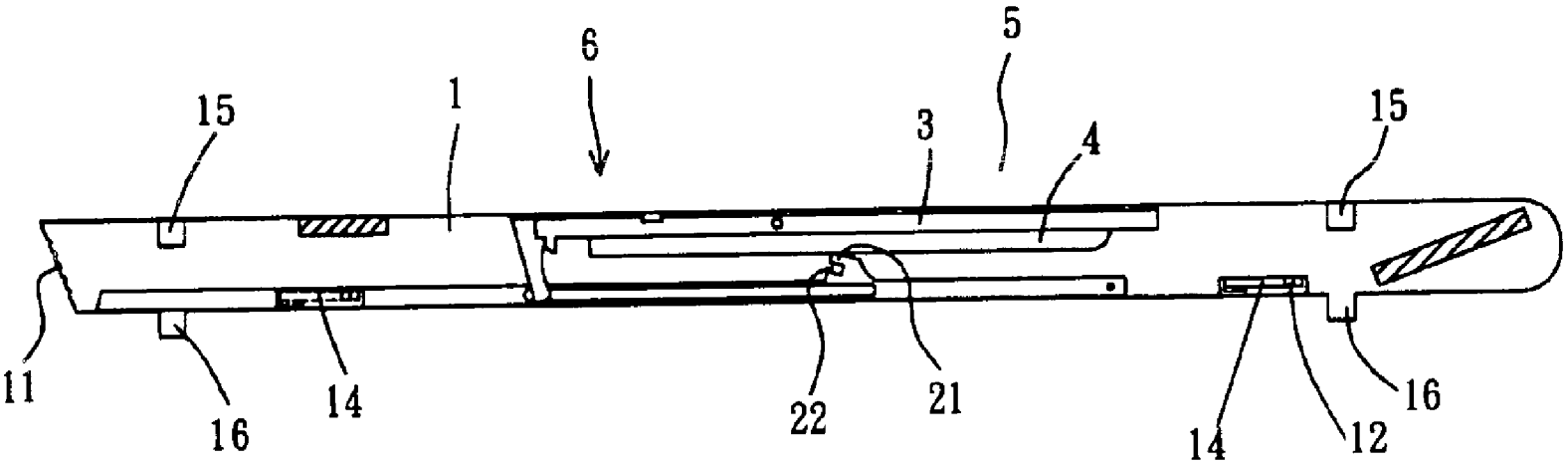
FIG. 9 is a plan cross-sectional view showing the foldable chair is collapsed.

Referring to FIG. 9 with reference to FIGS. 1–6, when not in use, the front end of the support frame 3 of the seat module 5 is moved upward to move and detach the catch portion 32 of the support frame 3 from the locking recess 22 of the holding portion 21 of the second leg 2, so that the seat module 5 and the second leg 2 are pivoted relative to the first leg 1 to form a parallel state, thereby folding the foldable chair 6 as shown in FIG. 9.

Figure 10:
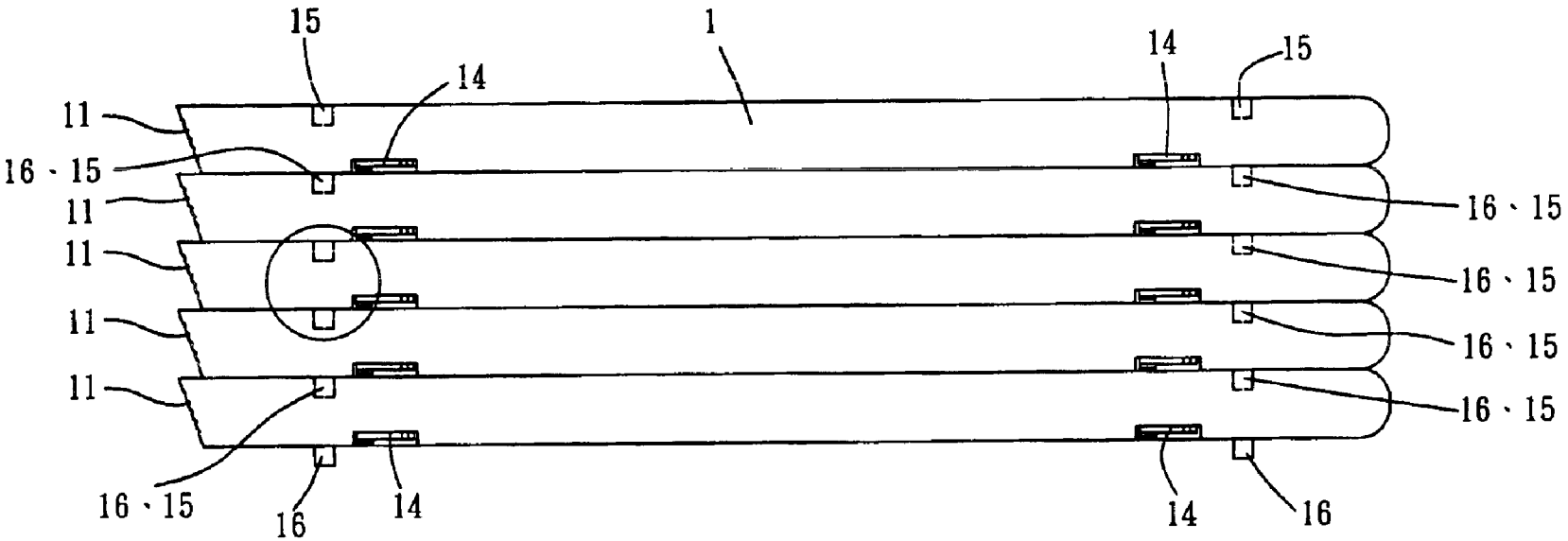
FIG. 10 is a plan view showing a plurality of collapsed foldable chairs are combined.
Figure 11:
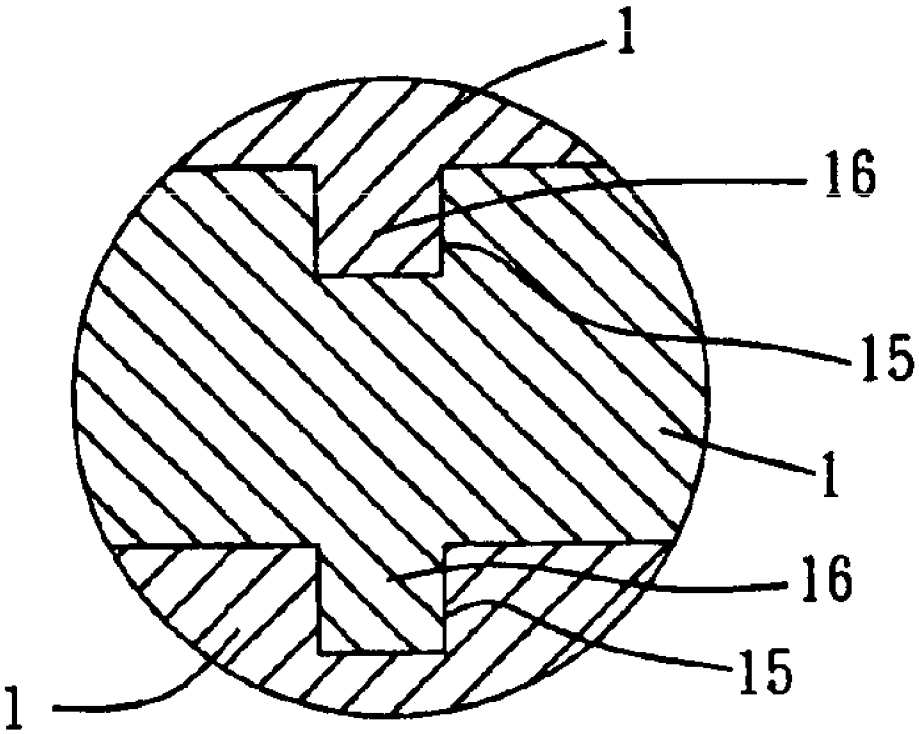
FIG. 11 is a partially enlarged cross-sectional view of the collapsed foldable chairs as shown in FIG. 10.

Referring to FIGS. 10 and 11 with reference to FIGS. 1–6, when a plurality of collapsed foldable chairs 6 are juxtaposed with each other, the convex portion 16 of one collapsed foldable chair 6 is inserted into the respective concave portion 15 of another adjacent collapsed foldable chair 6, so as to combine the collapsed foldable chairs 6. Thus, the collapsed foldable chairs 6 are combined with and detached from each-other easily and rapidly, thereby facilitating the user combining and detaching the collapsed foldable chairs 6. In addition, the collapsed foldable chairs 6 are laminated rigidly and stably when not in use as shown in FIG. 10, thereby preventing the collapsed foldable chairs 6 from falling down unintentionally so as to protect the people's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable chair, comprising a first leg, a second leg pivotally connected with the first leg, and a seat module pivotally mounted on the first leg and detachably locked on the second leg, wherein:

the second leg is formed with a holding portion formed with a locking recess;

the seat module includes a support frame pivotally connected with the first leg;

the support frame of the seat module has an end formed with a catch portion snugly fitted in the locking recess of the holding portion of the second leg when the support frame of the seat module is disposed at a horizontal position, so that the support frame of the seat module is secured to the second leg;

the seat module further includes a seat cushion secured on the support frame;

the support frame of the seat module has a periphery formed with a plurality of locking holes, and the seat cushion has a periphery formed with a plurality of elastic locking tenons each locked in a respective one of the locking holes of the support frame, so that the seat cushion is secured on the support frame.

2. The foldable chair in accordance with claim 1, wherein the first leg has a lower end formed with an anti-skid face.

3. The foldable chair in accordance with claim 1, wherein the second leg has a lower end formed with an anti-skid face.

4. A foldable chair comprising a first leg, a second leg pivotally connected with the first leg, and a seat module pivotally mounted on the first leg and detachably locked on the second leg, wherein the second leg is formed with a holding portion formed with a locking recess;

the seat module includes a support frame pivotally connected with the first leg;

the support frame of the seat module has an end formed with a catch portion snugly fitted in the locking recess of the holding portion of the second leg when the support frame of the seat module is disposed at a horizontal position, so that the support frame of the seat module is secured to the second leg;

the first leg has a first side formed with two spaced first openings each provided with a movable snap and a second side formed with two spaced second openings each provided with a protruding post.

5. The foldable chair in accordance with claim 4, wherein each of the first side and the second side of the first leg has two ends each having a first section formed with a concave portion and a second section formed with a convex portion aligning with the concave portion.

6. The foldable chair in accordance with claim 5, wherein when a plurality of the collapsed foldable chairs are juxtaposed with each other, the convex portion of one collapsed foldable chair is inserted into the respective concave portion of another adjacent collapsed foldable chair, so as to stack the collapsed foldable chairs.

7. The foldable chair in accordance with claim 4, wherein when a plurality of the expanded foldable chairs are juxtaposed with each other, the movable snap of one foldable chair is pivoted outward and is locked on the respective protruding post of another adjacent foldable chair, so as to fasten the foldable chairs together.

* * * * *